United States Patent [19]
Ambros et al.
[11] 4,440,673
[45] Apr. 3, 1984

[54] METHOD OF AND APPARATUS FOR THE TREATMENT OF RADIOACTIVE WASTE WATER FROM NUCLEAR POWER PLANTS

[75] Inventors: Rainer Ambros, Biblis; Norbert Brenner, Bürstadt; Jürgen Fischer, Essen, all of Fed. Rep. of Germany

[73] Assignee: Rheinisch-Westfälisches Elektrizitätswerk AG, Essen, Fed. Rep. of Germany

[21] Appl. No.: 132,084

[22] Filed: Mar. 20, 1980

[30] Foreign Application Priority Data

Mar. 22, 1979 [DE] Fed. Rep. of Germany ..... 2911272

[51] Int. Cl.[3] ..... G21F 9/14

[52] U.S. Cl. ..... 252/632; 252/631; 252/628; 376/313

[58] Field of Search ..... 176/37, 38, 65; 252/626, 628, 631, 633, 634, 635, 637, 632; 210/751; 23/300; 376/313

[56] References Cited

U.S. PATENT DOCUMENTS

| | | | |
|---|---|---|---|
| 3,142,648 | 7/1964 | Lefillarte | 252/628 |
| 3,852,044 | 12/1974 | Neitzel et al. | 23/300 |
| 3,940,628 | 2/1976 | Stock | 176/37 |
| 4,024,911 | 5/1980 | Cooper | 176/37 |
| 4,028,265 | 7/1977 | Barney et al. | 252/626 |
| 4,043,865 | 8/1977 | Kausz | 176/37 |
| 4,056,362 | 11/1977 | Gablin | 176/37 |
| 4,119,561 | 10/1978 | Drobnick et al. | 252/629 |
| 4,120,933 | 10/1978 | Silver | 252/631 |
| 4,122,028 | 10/1978 | Iffland et al. | 252/631 |
| 4,238,334 | 12/1980 | Halbfoster | 210/777 |
| 4,253,985 | 3/1981 | Filter | 252/628 |
| 4,297,304 | 10/1981 | Schneffler et al. | 264/0.5 |

FOREIGN PATENT DOCUMENTS

| | | |
|---|---|---|
| 1088624 | 9/1960 | Fed. Rep. of Germany . |
| 2447471 | 4/1976 | Fed. Rep. of Germany . |

OTHER PUBLICATIONS

Noyes Data Corporation, *Radioactive Waste Disposal*, Park Ridge, N.J., 1977, (W. Gilmore, ed.), pp. 133–134, (hereinafter–"Gilmore").

*Primary Examiner*—Sal Cangialosi
*Attorney, Agent, or Firm*—Karl F. Ross; Herbert Dubno

[57] ABSTRACT

A method of and an apparatus for the treatment of radioactive waste water from a nuclear electricity-generating power plant. The radioactive waste water containing soluble solids, usually boric acid, is concentrated by evaporation according to the invention to a solids concentration above that which will form a saturated solution at room temperature, whereupon the resulting concentrate is introduced into a storage vessel and cooled therein to room temperature. Solids precipitate and sediment in this vessel and water is decanted from the sediment and recycled to the evaporator where the process is repeated. The process allows the amount of waste in terms of the original material treated which must be stored for a given prolonged period, say between one half and three quarters of a year, for radioactive decay prior to packaging of the waste to be significantly reduced by comparison with earlier systems.

1 Claim, 1 Drawing Figure

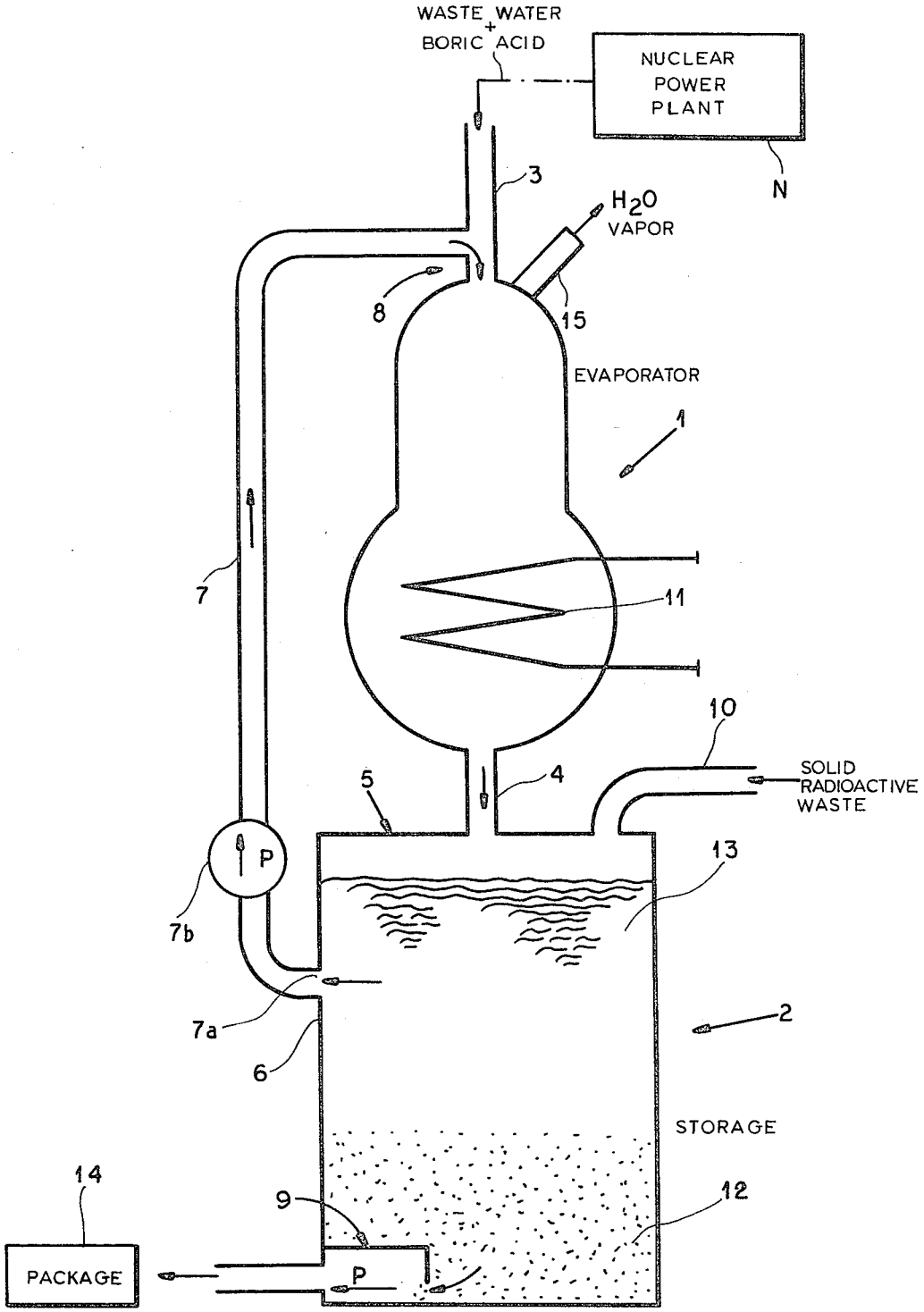
WASTE WATER
+
BORIC ACID
NUCLEAR
POWER
PLANT
N
3
$H_2O$
VAPOR
8
15
EVAPORATOR
1
7
11
10
SOLID
RADIOACTIVE
WASTE
5
4
P
13
7b
7a
2
6
STORAGE
14
9
12
PACKAGE
P

METHOD OF AND APPARATUS FOR THE TREATMENT OF RADIOACTIVE WASTE WATER FROM NUCLEAR POWER PLANTS

FIELD OF THE INVENTION

Our present invention relates to a method of treatment of radioactive waste water of the type which must be removed or discharged from time to time from nuclear electricity-generating power plants.

BACKGROUND OF THE INVENTION

Nuclear electricity-generating power plants of practically all types from time to time must dispose of radioactive waste water which can be derived from secondary or tertiary coolant cycles, from water in contact with contaminated materials or zones, or from the steam-generating system.

In general the radioactive waste water which must be disposed of often contains solids, especially boric acid, which are in dissolved form.

A conventional disposal technique is to store the radioactive waste water for a period sufficient to allow decay of some of the radioactive substances therein and then subject the stored water (with reduced radioactive level) to waste-water processing by any of a number of techniques including chemical precipitation or biological treatment.

A disadvantage of this approach is the need to store relatively large quantities of water for long periods of time.

It has also been proposed to concentrate the waste water and thereby reduce the volume of this substance which must be handled. In this conventional process, the waste water is concentrated by evaporation and the evaporation is carried out until the solids concentration in the water is at a level less than that which would represent a saturated solution at room temperature. The water is then stored for decay of radiation, e.g. for one half to three quarters of a year and then packaged, e.g. by incorporation in a solid mass, for permanent disposal and transportation.

The permanent disposal may involve mixing the concentrated water with cement, (e.g. hydraulic cement) or incorporating the water in a hardenable bitumen or in a synthetic resin mass.

In all cases the hardened material constitutes a leach-resistant body which can be sealed in a container, canister or drum with or without significant radiation-shielding capacity, the resulting package being given subterranean storage or being otherwise disposed of by techniques conventional in this art.

The incorporation of the radioactive waste, whose activity has been reduced by long-term storage, in a hardenable mass prevents contamination of the environment in a particularly effective manner and the concentration step reduces significantly the volume of the material which must be handled in this manner.

However, the degree of concentration is limited in the prior art process by the need to prevent the concentration of solids, during evaporation, from reaching the saturation concentration at room temperature, thereby ensuring that no solids will precipitate from the water and deposit in the system.

The storage vessels which are commonly used for the radioactive decay process may have volumes of about 60 $m^3$ and consequently, the cost of a storage facility for the interim storage of the waste water can be considerable and the operating cost of the power plant correspondingly high.

OBJECTS OF THE INVENTION

It is the principal object of the present invention to provide an improved method of treating radioactive waste water from a nuclear power plant whereby the disadvantages of earlier systems mentioned can be avoided.

Another object of this invention is to provide an improved method of operating a nuclear power plant to minimize the cost and inconvenience heretofore encountered with long term large volume waste water storage.

Yet another object is to provide a method of treatment of radioactive waste water from a nuclear power plant whereby the ratio of storage capacity to processed water can be reduced and the time between successive discharge of such water can be increased thereby improving the efficiency of the nuclear power plant.

SUMMARY OF THE INVENTION

These objects are attained, in accordance with the present invention, which provides a method in which the radioactive waste water of the nuclear electricity-generating power plant, containing soluble solids and especially boric acid, is concentrated by evaporation to a solids concentration above that which prevails in a saturated solution at room temperature and thereupon introducing the concentrate into a storage vessel in which the concentrate is cooled to cause precipitation of the solids. The solids are permitted to sediment (settle) from the liquid and liquid from which the solids have settled is decanted and recycled to the evaporator for further concentration. Eventually the sludge or slurry in the storage tank can be withdrawn and processed in the manner known in the art for the stored waste water although because of the repeated and cyclical concentration, is of smaller volume for a given amount of the starting material.

The invention thus provides a significantly higher degree of concentration than has been contemplated heretofore and especially utilizes sludge or sediment formation to allow a smaller storage capacity to accommodate the material for long term storage in a power plant of a given output and/or allows a given storage capacity to process far more of the radioactive waste water originating in a plant than heretofore, thereby increasing the periods between discharges of the respective tanks. It is important to note that the contents of a given tank as part of the long-term storage or prior to the commencement thereof, consists of a waste water which has been concentrated several or many times by evaporation without any danger that there will be a deposit in the evaporator since each concentration is effected to a subsaturation level at the temperature in the concentrator (evaporator) or the lines thereof leading to the tank, but to a concentration above the saturation level at room temperature whereby precipitation of some solids from the concentrated liquid of each recycling is ensured.

When attempts in the past have been made to increase the concentration of the liquid in the evaporator, deposits invariably formed within the evaporator or in the pipes leading therefrom.

According to the invention, the process can be carried out as frequently as is necessary with recycling and until the entire storage vessel is filled with the sediment sludge up to the point at which the decantate is drawn off.

According to a feature of the invention, the waste water concentrate is held at a temperature of at least 50° C. from the point at which it enters an evaporator to the point at which it is discharged into the storage stage or vessel.

It has been found to be advantageous, moreover, to introduce into the storage tank radioactive solids, especially diatomaceous earth which may be recovered from filters in which this filter aid is trapped, such solids being recovered from further treatment of the waste water or from treatments of the sump water of nuclear power plants. In general, such solids or even the sump waters themselves containing entrained solids, are introduced into the system separately from the waste water to be concentrated, e.g. directly in the storage stage with the decantate being concentrated in the manner described. This results in a more efficient utilization of the storage capacity.

Surprisingly, these solids have the tendency to loosen the sedimented sludge and to keep the latter more flowable and lighter so that the sludge may be more readily handled. In addition, when diatomaceous earth, for example, is added to the sludge, the hydraulic cement serving as a hardening agent forms a mass which has greater stability than otherwise is the case and allows less of the portland cement to be used so that the disposal system is more cost efficient as well.

The apparatus for carrying out the process of the present invention can comprise a storage vessel which is surmounted by an evaporator in which the concentration takes place and which opens downwardly into the storage vessel. At a point above the bottom of this vessel, a pipe opens into the storage vessel for recycling the decantate to the evaporator and this pipe may be united with a feed pipe through which the waste water is withdrawn from the nuclear reactor. A further pipe may open directly into the storage vessel for delivering the contaminated diatomaceous earth thereto.

The collected sedimented sludge may be discharged from the storage tank by an immersion pump, a swirl lance or the like.

Experiments have shown that the system of the present invention can, for tanks of the given storage capacity and for the same nuclear power plant, delay the need to discharge each tank and process the contents thereof to a period twice as long with the present invention than with the prior art system described in which only a single concentration to a point above the saturation level at room temperature is carried out.

Since the residence time in the storage vessel can be increased, e.g. to two or more times the residence time heretofore, the discharge and further treatment costs can also be reduced.

BRIEF DESCRIPTION OF THE DRAWING

The above and other objects, features and advantages of the present invention will become more readily apparent from the following description, reference being made to the accompanying drawing in which the sole FIGURE is a diagrammatic vertical cross-sectional view showing an apparatus for carrying out the process of the present invention.

SPECIFIC DESCRIPTION

The apparatus shown in the drawing comprises an evaporator 1 surmounted upon a storage tank 2 and receiving waste water containing dissolved solids, especially boric acid, from nuclear electricity-generating power plant N.

The outlet 4 of the evaporator 1 which may be fluid powered or electrically energized as represented by the coil 11, opens into the storage tank 2 at the head 5 thereof.

In the upper half 6 of this storage tank, there is provided an outlet *7a* through which the liquid (decantate) is recirculated vial line 7 to the inlet 8 of the evaporator 1. A pump *7b* can displace the liquid along this line.

The sludge 12 sedimenting from the clear liquid 13 in tank 2 can be discharged via an immersion pump 9 for packaging it at a station 14 in which the sludge is mixed with portland cement and allowed to set in sealable receptacles.

A pipe 10 feeds solid radioactive wastes, e.g. diatomaceous earth or other filter aids, in the form of a slurry or sludge to the tank 2.

In operation, the radioactive waste water containing dissolved boric acid is fed via line 3 to the evaporator 1 in which the solution is concentrated, the vapor phase being discharged at 15. The concentration of the water admitted to the storage vessel 2 is below the saturation level at the evaporation temperature and the temperature at which the solution is passed into the storage vessel (at least 50° C.) but above the saturation level at room temperature. Thus in the evaporator 1 and in the connecting duct 4 no solids pass out of the solution.

In the storage vessel 2 the waste water concentrate is cooled to room temperature and solids deposit and sediment so that clear liquid can be decanted and recycled to the evaporator with renewed concentration in the manner described. When the tank is more or less filled with the sludge it can be discharged via the pump 9 for processing as described, the sludge having in the interim undergone the long-term storage described.

We claim:

1. A method of treating radioactive waste water from a nuclear reactor containing dissolved boric acid which comprises the steps of:

(a) concentrating radioactive waste water containing dissolved boric acid derived from a nuclear reactor in an evaporator to a boric acid concentration in a concentration below the boric acid saturation level at the temperature of the concentrate but above the saturated level of the concentrate for boric acid at room temperature;

(b) collecting the concentrate following step (a) at a temperature of at least 50° C. in a storage tank and permitting the concentrate in said storage tank to cool to room temperature and adding a radioactive solid waste containing diatomaceous earth to the tank, thereby precipitating boric acid solids from the concentrate in said tank and permitting the precipitate to sediment as a sludge therein;

(c) thereafter decanting clear concentrate from the sedimented boric-acid-containing sludge in said tank and recycling the decanted clear concentrate to the evaporator of step (a);

(d) repeating steps (b) and (c) while accumulating sludge in said tank thereby enabling radiation in the waste water to decay; and (e) discharging the sludge from said tank upon its accumulation therein to a predetermined level.

* * * * *